US005487446A

United States Patent [19]

Patnode et al.

[11] Patent Number: 5,487,446

[45] Date of Patent: Jan. 30, 1996

[54] APPARATUS FOR SELF-ADJUSTING THE HEIGHT OF AN OUTRIGGER ATTACHABLE TO SCAFFOLDING

[76] Inventors: Eric T. Patnode, P.O. Box 8; Brian J. Jarvis, P.O. Box 2, both of Isle Lamotte, Vt. 05463

[21] Appl. No.: 239,464

[22] Filed: May 9, 1994

[51] Int. Cl.[6] ..... E04G 1/20

[52] U.S. Cl. ..... 182/148; 182/146

[58] Field of Search ..... 182/148, 146, 182/178, 179, 82, 141; 248/235, 243, 244

[56] References Cited

U.S. PATENT DOCUMENTS

| | | | |
|---|---|---|---|
| 1,442,075 | 1/1923 | Knechtel | 182/148 X |
| 3,610,368 | 10/1971 | Johnson | 182/146 |
| 4,534,446 | 8/1985 | Pujol | 182/146 |

FOREIGN PATENT DOCUMENTS

| | | | |
|---|---|---|---|
| 150011 | 9/1920 | United Kingdom | 182/148 |

*Primary Examiner*—Alvin C. Chin-Shue

[57] ABSTRACT

An apparatus for self-adjusting the height of an outrigger attachable to scaffolding comprising a support having a back wall and side walls with a plurality of apertures located along the length of the back wall, the exterior of the back wall having clamps for removable coupling with tubular scaffolding. The apparatus further includes a vertically disposed angle iron positioned parallel with the support on the side there opposite from the clamps and having coupled thereto at its upper and lower ends a wheel carriage for riding within the support. The apparatus further includes an outrigger platform extending forwardly from the angle iron and secured thereto for supporting an operator standing on the platform. The apparatus further includes motion imparting means to move the platform with respect to the support.

3 Claims, 4 Drawing Sheets

APPARATUS FOR SELF-ADJUSTING THE HEIGHT OF AN OUTRIGGER ATTACHABLE TO SCAFFOLDING

BACKGROUND OF THE INVENTION

1. Field of the Invention

The present invention relates to an apparatus for self-adjusting the height of an outrigger attachable to scaffolding and more particularly pertains to varying the height of an outrigger for scaffolding from a location on the outrigger.

2. Description of the Prior Art

The use of Scaffolding with outriggers of various designs is known in the prior art. More specifically, scaffolding with outriggers of various designs heretofore devised and utilized for the purpose of adjusting the height of an outrigger on scaffolds are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,684,058 a scaffold.

U.S. Pat. No. 3,854,550 discloses a mobile outrigger for scaffolds.

U.S. Pat. No. 4,194,591 discloses a mobile scaffold with fixed-use-position outriggers.

U.S. Pat. No. 4,496,027 discloses a mobile outrigger for suspending scaffold.

Lastly, U.S. Pat. No. 4,821,844 discloses an outrigger for scaffolding.

In this respect, the apparatus for self-adjusting the height of an outrigger attachable to scaffolding according to the present invention substantially departs from the conventional concepts and designs of the prior art, and in doing so provides an apparatus primarily developed for the purpose of varying the height of an outrigger for scaffolding from a location on the outrigger.

Therefore, it can be appreciated that there exists a continuing need for a new and improved apparatus for self-adjusting the height of an outrigger attachable to scaffolding which can be used for varying the height of an outrigger for scaffolding from a location on the outrigger. In this regard, the present invention substantially fulfills this need.

SUMMARY OF THE INVENTION

In view of the foregoing disadvantages inherent in the known types of Scaffolding with outriggers of various designs now present in the prior art, the present invention provides an improved apparatus for self-adjusting the height of an outrigger attachable to scaffolding. As such, the general purpose of the present invention, which will be described subsequently in greater detail, is to provide a new and improved apparatus for self-adjusting the height of an outrigger attachable to scaffolding and method which has all the advantages of the prior art and none of the disadvantages.

To attain this, the present invention essentially comprises a new and improved apparatus for self-adjusting the height of an outrigger attachable to scaffolding comprising, in combination, a C-channel support having a back wall and side walls with a plurality of apertures located along the length of the back wall, the exterior of the back wall having clamps for removable coupling with tubular scaffolding. The apparatus further comprises a vertically disposed angle iron positioned parallel with the support on the side there opposite from the clamps and having coupled thereto at its upper and lower ends a wheel carriage for riding within the C-channel support. The apparatus further comprises an outrigger platform extending forwardly from the angle iron and secured thereto for supporting an operator standing on the platform. The apparatus further comprises a rotatable handle secured with respect to the angle iron at an upper extent thereof for rotation by an operator, the handle having at its interior end a bevel gear and a large sprocket gear with peripheral teeth for rotation upon rotation of the handle, the teeth adapted to sequentially engage next adjacent apertures of the channel support upon rotation of the handle to effect the raising and lowering of the angle iron and platform upon rotation of the handle in either one direction. The apparatus further comprises a brake rod having an upper end pivoted to the angle iron and the lower end with a finger adapted to be positioned into a predetermined aperture on the channel support, and a lever pivotally secured to the angle iron coupled to the brake rod tending to withdraw the finger from the aperture upon the pressing of the lever. The apparatus further comprises a spring coupled at its upper end to the angle iron and at its lower end to a preselected area of the brake rod tending to urge the finger into a preselected aperture for locking purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for self-adjusting the height of an outrigger attachable to scaffolding which has all the advantages of the prior art Scaffolding with outriggers of various designs and none of the disadvantages.

It is another object of the present invention to provide a new and improved apparatus for self-adjusting the height of an outrigger attachable to scaffolding which may be easily and efficiently manufactured and marketed.

It is a further object of the present invention to provide a new and improved apparatus for self-adjusting the height of an outrigger attachable to scaffolding which is of durable and reliable constructions.

An even further object of the present invention is to provide a new and improved apparatus for self-adjusting the height of an outrigger attachable to scaffolding which is susceptible of a low cost of manufacture with regard to both materials and labor, and which accordingly is then susceptible of low prices of sale to the consuming public, thereby making such apparatus for self-adjusting the height of an outrigger attachable to scaffolding economically available to the buying public.

Still yet another object of the present invention is to provide a new and improved apparatus for self-adjusting the height of an outrigger attachable to scaffolding which provides in the apparatuses and methods of the prior art some of the advantages thereof, while simultaneously overcoming some of the disadvantages normally associated therewith.

Still another object of the present invention is to vary the height of an outrigger for scaffolding from a location on the outrigger.

Lastly, it is an object of the present invention to provide a new and improved apparatus for self-adjusting the height of an outrigger attachable to scaffolding comprising a support having a back wall and side walls with a plurality of apertures located along the length of the back wall, the exterior of the back wall having clamps for removable coupling with tubular scaffolding. The apparatus further includes a vertically disposed angle iron positioned parallel with the support on the side there opposite from the clamps and having coupled thereto at its upper and lower ends a wheel carriage for riding within the support. The apparatus further includes an outrigger platform extending forwardly from the angle iron and secured thereto for supporting an operator standing on the platform. The apparatus further includes motion imparting means to move the platform with respect to the support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
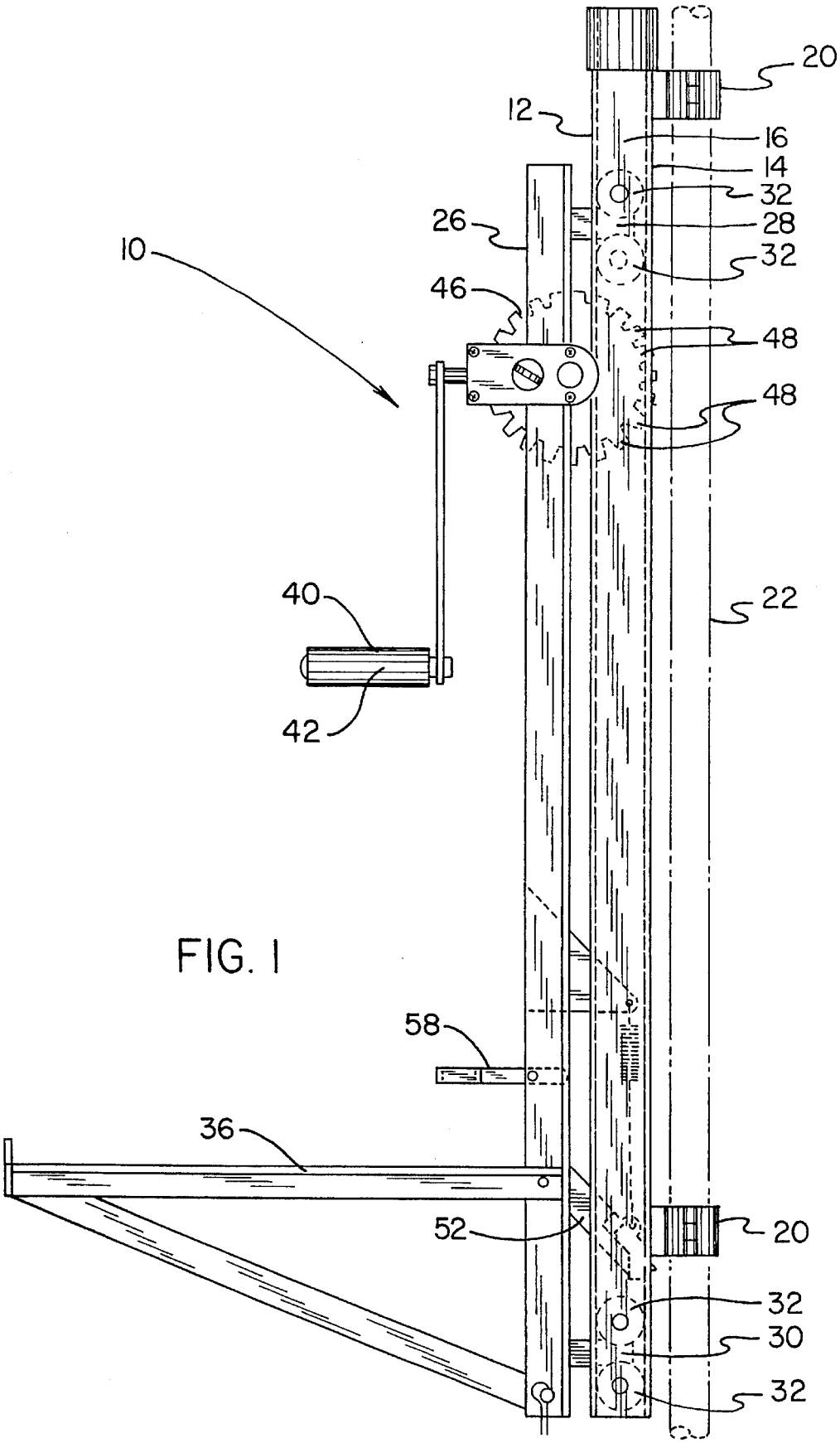
FIG. 1 is a side elevational view of the preferred embodiment of the apparatus for self-adjusting the height of an outrigger attachable to scaffolding constructed in accordance with the principles of the present invention.
Figure 2:
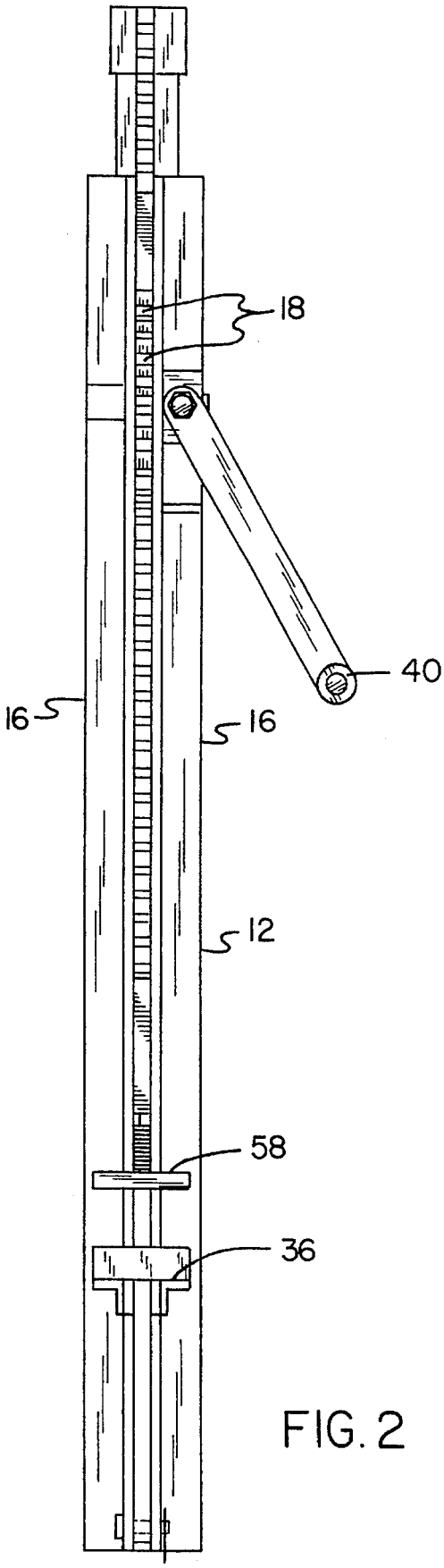
FIG. 2 is a front elevational view of the device illustrated in FIG. 1.
Figure 3:
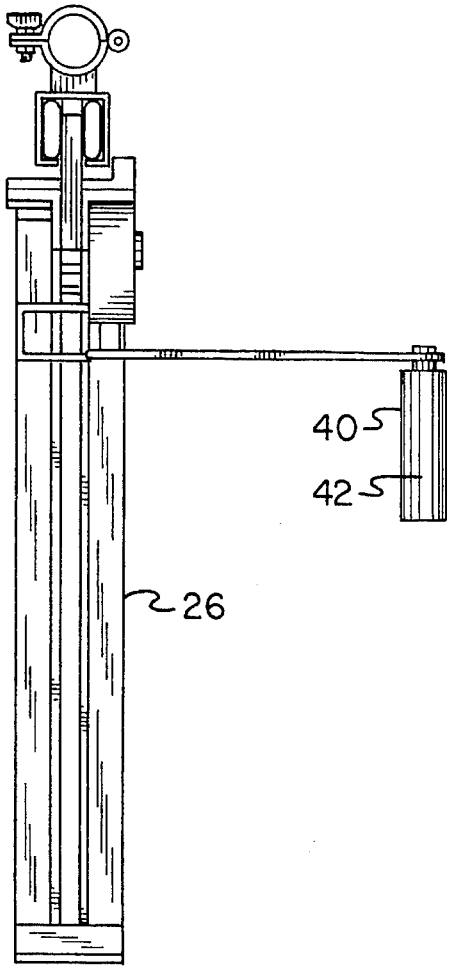
FIG. 3 is a top plan view of the device illustrated in FIGS. 1 and 2.
Figure 4:
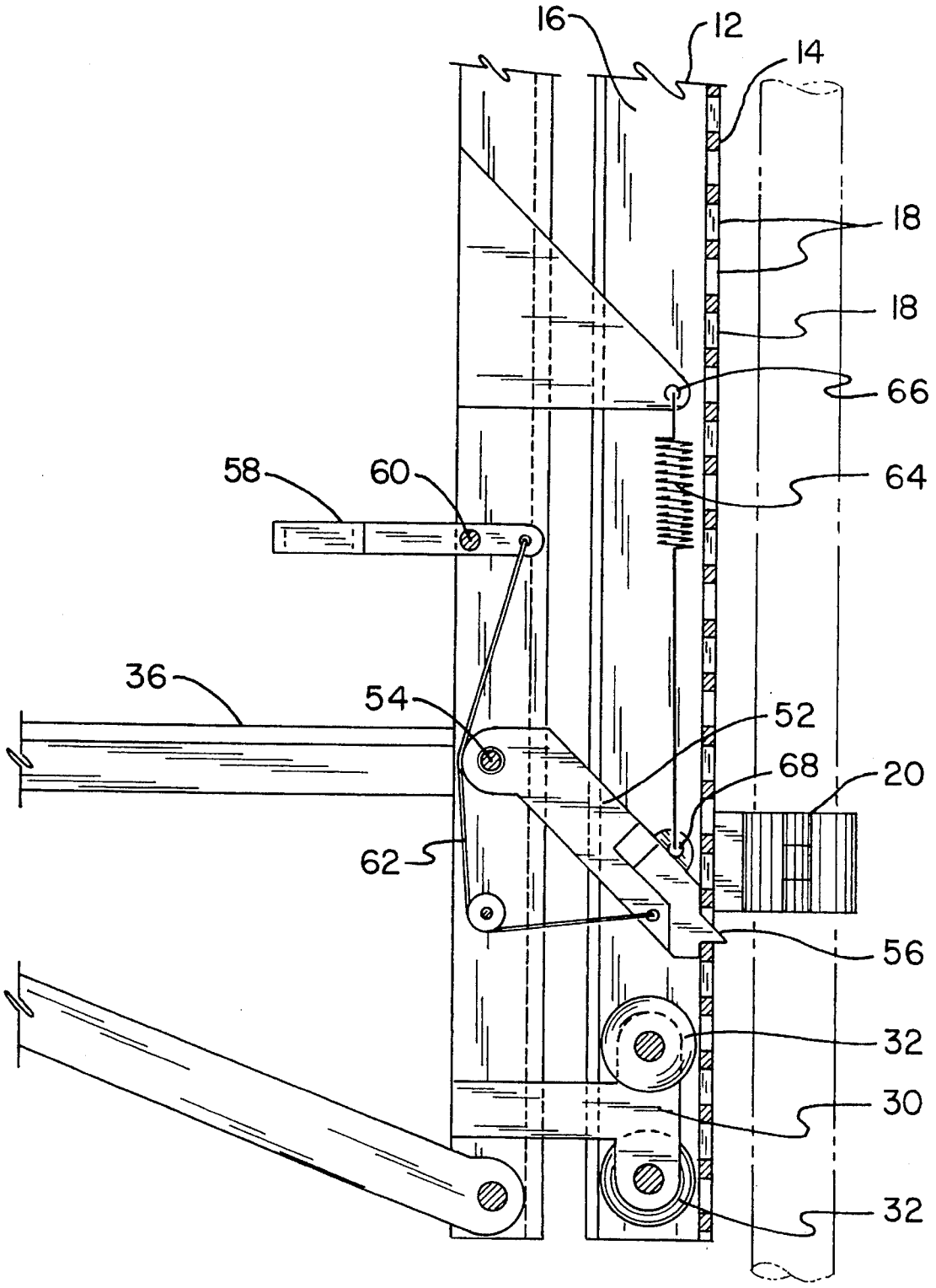
FIG. 4 is an enlarged side elevational view partly in cross-section illustrating certain internal components at the lower end of the device as shown in FIGS. 1 and 2.
Figure 5:
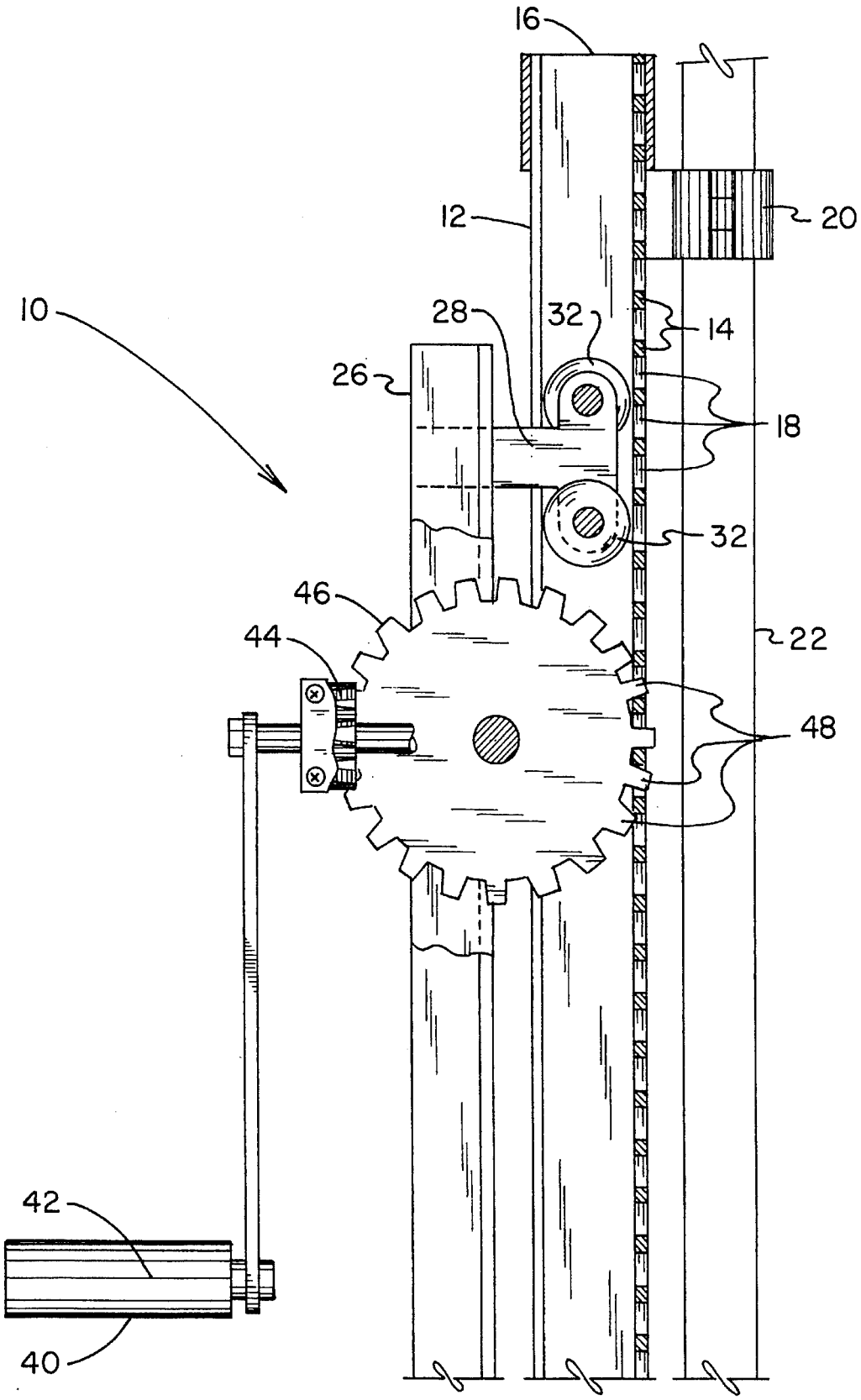
FIG. 5 is an enlarged side elevational view partly in cross-section showing the upper end of the device illustrated in FIGS. 1 and 2.

With reference now to the drawings, and in particular to FIG. 1 thereof, the preferred embodiment of the new and improved apparatus for self-adjusting the height of an outrigger attachable to scaffolding embodying the principles and concepts of the present invention and generally designated by the reference numeral 10 will be described.

The present invention, the new and improved apparatus for self-adjusting the height of an outrigger attachable to scaffolding, is comprised of a plurality of components. In their broadest context, such components include a support, angle iron, an outrigger platform, a rotatable handle, a brake rod and a spring. Such components are specifically configured and correlated with respect to each other so as to attain the desired objective.

More specifically, the present invention is a system 10. The central part of the system is a C-channel support 12. Such support has a back wall 14 and parallel side walls 16. A plurality of apertures 18 are located along the length of the back wall at spaced locations. The exterior of the back wall is provided with clamps 20 for removable coupling with respect to tubular scaffolding 22 to which the aperture is to be utilized.

Operatively coupled with respect to the C-channel support is a vertically disposed angle iron 26. The angle iron is positioned within the side walls of the support parallel with the channel support. It is on the side thereof opposite from the clamps. Coupled with respect to the angle iron is an upper wheel carriage 28 and a lower wheel carriage 30. The wheel carriages are for providing stability to the angle iron when moved with respect to the support. The wheels 32 of the carriage ride within the C-channel support in contact with the back wall.

Coupled with respect to the angle iron is an outrigger platform 36. Such platform extends forwardly from the angle iron away from the clamps. It is secured to the angle iron. It is of sufficient strength for supporting an operator standing on the platform.

Movement is provided to the platform by a rotatable handle 40. Such handle is secured with respect to the angle iron at an upper extent thereof to render it conveniently located for the operator. The handle is mounted for rotation by the operator. The handle has a grip 42 at its exterior end. It also has a bevel gear 44 at its interior end. Coupled with respect to the bevel gear is a large sprocket gear 46. The peripheral teeth 48 of the large sprocket gear are adapted for rotation upon rotation of the handle. The teeth thus are oriented to sequentially engage next adjacent apertures of the channel support upon rotation of the handle. This is to effect the raising and lowering of the angle iron and platform with respect to the scaffolding upon rotation of the handle in one direction or the other.

When the handle is not being rotated, a break rod 52 is provided to effect the secure positioning of the angle iron and platform. This is through the break rod having an upper end pivoted to the angle iron through a pin 54. The lower end of the break rod has a finger 56 adapted to be positioned into a predetermined aperture of the channel support. Coupled with respect thereto is a lever 58 secured by a pin 60 to the angle iron. The lever is couple to the break rod by a cable 62 and tends to withdraw the finger from its associated aperture upon an operator pressing the lever.

The last component of the system is a spring 64. The spring is coupled at its upper end 66 to the angle iron. It is coupled at its lower end 68 to a preselected area of the break rod. Such arrangement tends to urge the finger of the break rod into a preselected aperture in which it was last positioned for locking purposes for the safety of an operator standing on the outrigger platform when working at all times so long as the handle is not being rotated.

The present invention is a platform hoist which can be mounted on a scaffold to raise and lower workers so they can perform their work at the best level. The present invention cranks out from the vertical pipes used in the scaffolding, called an outrigger, and moves up and down on the pipe with a hand crank.

The platform is constructed of steel angles and bars and projects out at a right angle, approximately 20 inches from the scaffolding which is supported with sturdy bracing. It is about 36 inches in length and rides in a steel C-channel which is attached to the scaffolding pipe with heavy duty pipe clamps. The C-channel is slotted to accept the dual wheels which are mounted on brackets. This protrudes from the top and bottom of the platform and extends into the channel. The wheels roll along the inside of the walls to support the platform and to allow it to be raised and lowered easily and smoothly. Elevation and lowering of the platform is performed with the hand crank mounted on the back. When the crank is turned, a sprocket is rotated, traversing in slots which extend along the length of the C-channel. Spring loaded pawls engage the sprocket teeth to hold the platform in position. The system is provided with a spring loaded lever which engages any slot in the channel and wedges to prevent the platform from dropping down, serving as a brake. A safety line attached to the platform is tied through an array of holes along the sides of the channel to provide additional security.

The workers on the present invention are able to move themselves up and down with ease, by simply turning the crank handle. If they move to another level, the platform assembly is unclamped and relocated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for self-adjusting the height of an outrigger attachable to scaffolding comprising, in combination:

a C-channel support having a back wall and side walls with a plurality of apertures located along the length of the back wall, the exterior of the back wall having clamps for removable coupling with tubular scaffolding;

a vertically disposed angle iron positioned parallel with the support on the side there opposite from the clamps and having coupled thereto at its upper and lower ends a wheel carriage for riding within the C-channel support;

an outrigger platform extending forwardly from the angle iron and secured thereto for supporting an operator standing on the platform;

a rotatable handle secured with respect to the angle iron at an upper extent thereof for rotation by an operator, the handle having at its interior end a bevel gear and a large sprocket gear with peripheral teeth for rotation upon rotation of the handle, the teeth adapted to sequentially engage next adjacent apertures of the channel support upon rotation of the handle to effect the raising and lowering of the angle iron and platform upon rotation of the handle in either one direction;

a brake rod having an upper end pivoted to the angle iron and the lower end with a finger adapted to be positioned into a predetermined aperture on the channel support, and a lever pivotally secured to the angle iron coupled to the brake rod tending to withdraw the finger from the aperture upon the pressing of the lever; and a spring coupled at its upper end to the angle iron and at its lower end to a preselected area of the brake rod tending to urge the finger into a preselected aperture for locking purposes.

2. An apparatus for self-adjusting the height of an outrigger attachable to scaffolding comprising;

a support having a back wall and side walls with a plurality of apertures located along the length of the back wall, the exterior of the back wall having clamps for removable coupling with tubular scaffolding;

a vertically disposed angle iron positioned parallel with the support on the side there opposite from the clamps and having coupled thereto at its upper and lower ends a wheel carriage for riding within the support;

an outrigger platform extending forwardly from the angle iron and secured thereto for supporting an operator standing on the platform; and motion imparting means to move the platform with respect to the support;

a brake rod having an upper end pivoted to the angle iron and the lower end with a finger adapted to be positioned into a predetermined aperture on the channel support, and a lever pivotally secured to the angle iron coupled to the brake rod tending to withdraw the finger from the aperture upon the pressing of the lever.

3. The apparatus as set forth in claim 2 and further including a spring coupled at its upper end to the angle iron and at its lower end to a preselected area of the brake rod tending to urge the finger into a preselected aperture for locking purposes.

* * * * *